US005567567A

United States Patent [19]

Akiyama et al.

[11] Patent Number: 5,567,567

[45] Date of Patent: Oct. 22, 1996

[54] METHOD FOR PRODUCING ENCAPSULATED TONER FOR HEAT-AND-PRESSURE FIXING AND ENCAPSULATED TONER OBTAINED THEREBY

[75] Inventors: Koji Akiyama, Wakayama; Takashi Yamaguchi, Arida; Koji Kameyama, Wakayama-ken; Koji Shimokusa, Wakayama, all of Japan

[73] Assignee: Kao Corporation, Tokyo, Japan

[21] Appl. No.: 334,026

[22] Filed: Nov. 2, 1994

[30] Foreign Application Priority Data

Nov. 5, 1993 [JP] Japan ..... 5-301126

[51] Int. Cl.[6] ..... G03G 9/093

[52] U.S. Cl. ..... 430/138

[58] Field of Search ..... 430/137, 138

[56] References Cited

U.S. PATENT DOCUMENTS

| | | | |
|---|---|---|---|
| 2,297,691 | 10/1942 | Carlson | 430/138 |
| 2,357,809 | 9/1944 | Carlson | 95/11 |
| 3,269,626 | 8/1966 | Albrecht | 226/177 |
| 4,855,209 | 8/1989 | Martin et al. | 430/138 |
| 4,954,412 | 9/1990 | Breton et al. | 430/137 |
| 4,980,257 | 12/1990 | Anno et al. | 430/110 |
| 5,035,970 | 7/1991 | Hsieh et al. | 430/139 |
| 5,037,716 | 8/1991 | Moffat | 430/109 |
| 5,153,093 | 10/1992 | Sacripante et al. | 430/138 |
| 5,185,229 | 2/1993 | Sato et al. | 430/110 |

FOREIGN PATENT DOCUMENTS

| | | |
|---|---|---|
| 0485168 | 5/1992 | European Pat. Off. . |
| 0552785 | 1/1993 | European Pat. Off. . |
| 0587036 | 3/1994 | European Pat. Off. . |
| 0584640 | 3/1994 | European Pat. Off. . |
| 2305739 | 2/1973 | Germany . |
| 3432976 | 9/1984 | Germany . |
| 48-075032 | of 0000 | Japan . |
| 48-075033 | 10/1973 | Japan . |
| 50-044826 | 4/1975 | Japan . |
| 82000493 | 1/1982 | Japan . |
| 57-037353 | 3/1982 | Japan . |
| 58-205163 | 11/1983 | Japan . |
| 58-205162 | 11/1983 | Japan . |
| 61-056352 | 3/1986 | Japan . |
| 63-128362 | 5/1988 | Japan . |
| 63-128357 | 5/1988 | Japan . |
| 63-128358 | 5/1988 | Japan . |
| 63-128359 | 5/1988 | Japan . |
| 63-128360 | 5/1988 | Japan . |
| 63-128361 | 5/1988 | Japan . |
| 1185659 | 7/1989 | Japan . |
| 1185665 | 7/1989 | Japan . |
| 1185652 | 7/1989 | Japan . |
| 2162356 | 6/1990 | Japan . |
| 2190870 | 7/1990 | Japan . |
| 6130713 | 5/1994 | Japan . |
| 2245981 | 1/1992 | United Kingdom . |

OTHER PUBLICATIONS

Abstract, Database WPI, Wk 8935, Derwent Publications Ltd., London, GB, AN 89-253544 & JP-A-1 185 650.

*Primary Examiner*—John Goodrow

*Attorney, Agent, or Firm*—Birch, Stewart, Kolasch & Birch, LLP

[57] ABSTRACT

The encapsulated toner for heat-and-pressure fixing of the present invention having a heat-fusible core material containing at least a thermoplastic resin and a shell formed thereon so as to cover the surface of the core material is produced by the method having the steps of (a) dispersing in a shell-forming resin an additive selected from the group consisting of conductive materials, charge control agents, wax components, color pigments, particulate magnetic materials, and mixtures thereof to give a shell-forming resin containing the additive; (b) dissolving the shell-forming resin containing the additive in a mixture containing a core material-constituting monomer; (c) dispersing the mixture obtained in step (b) in an aqueous dispersant, and localizing the shell-forming resin containing the additive on the surface of droplets of the core-constituting material to give a polymerizable composition; and (d) polymerizing the polymerizable composition obtained in step (c) by in situ polymerization to form the core material, the shell in which the additive is dispersed covering the surface of the core material, whereby an encapsulated is formed.

18 Claims, 1 Drawing Sheet

METHOD FOR PRODUCING ENCAPSULATED TONER FOR HEAT-AND-PRESSURE FIXING AND ENCAPSULATED TONER OBTAINED THEREBY

BACKGROUND OF THE INVENTION

1. Field of the Invention

The present invention relates to a method for producing an encapsulated toner for heat-and-pressure fixing used for development of electrostatic latent images in electrophotography, electrostatic printing, or electrostatic recording, and to an encapsulated toner obtained by the above method.

2. Discussion of the Related Art

As described in U.S. Pat. Nos. 2,297,691 and 2,357,809 and other publications, conventional electrophotography comprises the steps of forming an electrostatic latent image by evenly charging a photoconductive insulating layer, subsequently exposing the layer to eliminate the charge on the exposed portion and visualizing the formed image by adhering colored charged fine powder, known as a toner, to the latent image (a developing process); transferring the obtained visible image to an image-receiving sheet such as a transfer paper (a transfer process); and permanently fixing the transferred image by heating, pressure application or other appropriate means of fixing (a fixing process).

As indicated above, the toner must meet the requirements not only of the development process, but also of the transfer process and the fixing process.

Generally, a toner undergoes mechanical frictional forces due to shear force and impact force during the mechanical operation in a developer device, and deteriorates after copying from several thousands to several ten thousands of sheets. The deterioration of the toner can be prevented by using a tough resin having such a high molecular weight that it can withstand the above mechanical frictional forces. However, this kind of a resin generally has such a high softening point that the resulting toner cannot be sufficiently fixed by a non-contact method, such as oven fixing, because of its poor thermal efficiency. Further, when the toner is fixed by a contact fixing method, such as a heat-and-pressure fixing method using a heat roller, which is excellent in thermal efficiency and therefore widely used, it becomes necessary to raise the temperature of the heat roller in order to achieve sufficient fixing of the toner, which brings about such disadvantages as deterioration of the fixing device and curling of the paper. Furthermore, the resin described above is poor in grindability, thereby remarkably lowering the production efficiency of the toner. Accordingly, the binder resin having too high of a degree of polymerization and also too high of a softening point cannot be used.

Meanwhile, according to the heat-and-pressure fixing method using a heat roller, the thermal efficiency is excellent, so that this method is widely used in various high-speed and low-speed copy machines. However, when the surface of a heat roller contacts the surface of the visible image, the toner is likely to cause a so-called "offset phenomenon," wherein the toner is adhered to the surface of the heat roller, and thus transferred to a subsequent transfer paper. In order to prevent this phenomenon, the surface of a heat roller is coated with a material having excellent release properties for the toner, and further a releasing agent such as a silicone oil is applied thereon. However, the method of applying a releasing agent is likely to bring about various problems such as high costs and device troubles.

Although processes for improving the offset phenomenon by unsymmetrizing or crosslinking the resins have been disclosed in Japanese Patent Examined Publication No. 57-493 and Japanese Patent Laid-Open Nos. 50-44836 and 57-37353, the fixing temperature has not yet been improved by these processes.

Since the lowest fixing temperature of a toner is generally between the temperature of low-temperature offsetting of the toner and the temperature of the high-temperature offsetting thereof, the serviceable temperature range of the toner is from the lowest fixing temperature to the temperature for high-temperature offsetting. Accordingly, by lowering the lowest fixing temperature as much as possible and raising the temperature at which high-temperature offsetting occurs as much as possible, the serviceable fixing temperature can be lowered and the serviceable temperature range can be widened, which enables energy saving, high-speed fixing and prevention of curling of paper.

From the above reasons, the development of a toner having excellent fixing ability and offset resistance has always been desired.

A method has been proposed to achieve low-temperature fixing by using an encapsulated toner comprising a core material and a shell formed thereon so as to cover the surface of the core material.

Among such toners, those having a core material made of a low-melting wax which is easily plastically deformable, as described in U.S. Pat. No. 3,269,626, Japanese Patent Examined Publication Nos. 46-15876 and 44-9880, and Japanese Patent Laid-Open Nos. 48-75032 and 48-75033, are poor in fixing strength, so that they can be used only in limited areas, although they can be fixed only by pressure. Further, in the case where toners having a liquid core material are used, the shell materials tend to break in the developer device and stain the inside thereof. Thus, it has been difficult to control the strength of the shell materials.

Therefore, as a toner for heat-and-pressure fixing, an encapsulated toner for heat roller fixing has been proposed, which comprises a core material made of a resin having a low glass transition temperature which serves to improve the fixing strength, though blocking at a high temperature may take place if used alone, and a shell made of a high-melting point resin wall which is formed by interfacial polymerization for the purpose of imparting a blocking resistance to the toner.

Such encapsulated toners are disclosed in Japanese Patent Laid-Open No. 61-56352, and encapsulated toners with further improvements have been proposed (see Japanese Patent Laid-Open Nos. 58-205162, 58-205163, 63-128357, 63-128358, 63-128359, 63-128360, 63-128361, and 63-128362). However, since these toners are prepared by a spray drying method, the equipments for the production thereof become complicated. In addition, they cannot fully exhibit the performance of the core material, because they have not come up with a solution for the problems by the shell material.

Therefore, an encapsulated toner using a compound having thermal dissociation property as a shell material (Japanese Patent Laid-Open No. 4-212169) and an encapsulated toner using an amorphous polyester as a shell material have been proposed (Japanese Patent Laid-Open No. 6-130713). In cases of producing the encapsulated toners mentioned above, from the viewpoint of simplifying the production process and the production facilities, the above encapsulated toners are advantageously produced by a process comprising the steps of suspending polymerizable monomers in a dispersion medium, and forming a shell by an interfacial polymerization or in situ polymerization.

On the other hand, the following additives are conventionally added in suitable amounts to the core material of the encapsulated toner. Conductive materials are added for improving cleanability and stabilizing triboelectric charges; charge control agents are added for controlling triboelectric charges to positive or negative polarity; wax components are added for improving offset resistance; color pigments are added for coloring; and particulate magnetic materials are added for magnetizing the toner.

The additives mentioned above are generally solids, which are mostly insoluble in the polymerizable monomers. Also, as for additives, such as charge control agents and color pigments, the additives are normally present in the form of aggregates of particles. Therefore, in the case of producing toners by suspension polymerization, toners are produced by a process comprising the steps of adding the above additives to the polymerizable monomers, sufficiently disintegrating in advance the aggregated particles using mixers such as a ball mill and a sand stirrer to disperse the particles into the polymerizable monomers; and polymerizing the monomers.

The additives, such as the charge control agents added for stabilizing triboelectric charges and the conductive materials added for improving cleanability, can exhibit excellent effects when the additives are present in the vicinity of the toner surface. However, when the additives are dispersed by the dispersion method as mentioned above, the additives are likely to be incorporated into the inner portion of the toner, so that few additives are present on the toner surface. Therefore, advantageous effects by adding the additives cannot be obtained.

In order to solve the problems, Japanese Patent Laid-Open Nos. 1-185652, 1-185659, and 1-185665 disclose methods for producing toners comprising the step of adding an additive or fine resin particles containing an additive to the toner obtained by suspension polymerization to fix the additive components on the toner surface. By these methods, the additives can be present on the surface of the toner to fully exhibit their functions. However, in these methods, the production facilities are costly, and the dispersion of the additives externally added on the toner surface is poor, and thereby the production stability of the toner becomes poor. Also, since not all of the additives are strongly fixed to the toner surface, insufficiently fixed additives may become detached upon printing, and thereby the inside of the machine is stained.

SUMMARY OF THE INVENTION

An object of the present invention is to provide a method for producing an encapsulated toner for heat-and-pressure fixing, wherein the functions of the additives can be suitably exhibited by locating inherently insoluble additives in the vicinity of the toner surface with good dispersion, and wherein no stains of toner dust in the machine take place and a low-temperature fixing can be achieved.

Another object of the present invention is to provide an encapsulated toner for heat-and-pressure fixing obtained by such a method.

As a result of intense research, the present inventors have found that the above problems can be eliminated by using a resin dispersed with various additives such as conductive materials as a shell-forming material of the encapsulated toner. The present invention is completed based upon this finding.

Specifically, the present invention is concerned with the following:

(1) A method for producing an encapsulated toner for heat-and-pressure fixing comprising a heat-fusible core material containing at least a thermoplastic resin and a shell formed thereon so as to cover the surface of the core material, comprising the steps of:
   (a) dispersing in a shell-forming resin an additive selected from the group consisting of conductive materials, charge control agents, wax components, color pigments, particulate magnetic materials, and mixtures thereof; and
   (b) carrying out in situ polymerization using a mixture containing a core material-constituting monomer and the shell-forming resin containing the additive obtained in step (a) to form the core material, the shell in which the additive is dispersed covering the surface of the core material;

(2) An encapsulated toner for heat-and-pressure fixing comprising a heat-fusible core material containing at least a thermoplastic resin and a shell formed thereon so as to cover the surface of the core material, wherein the shell comprises a shell-forming resin and at least a conductive material dispersed therein;

(3) An encapsulated toner for heat-and-pressure fixing comprising a heat-fusible core material containing at least a thermoplastic resin and a shell formed thereon so as to cover the surface of the core material, wherein the shell comprises a shell-forming resin and at least a color pigment dispersed therein; and (4) An encapsulated toner for heat-and-pressure fixing comprising a heat-fusible core material containing at least a thermoplastic resin and a shell formed thereon so as to cover the surface of the core material, wherein the shell comprises a shell-forming resin and at least particulate magnetic materials dispersed therein.

In the encapsulated toner for heat-and-pressure fixing obtained in the present invention, since various additives are dispersed in the shell resin without being present on the shell surface of the toner, problems incurred by generating toner dust in machine due to detachment of various additives upon stirring in the developer device are eliminated. Also, the function of the various additives is well exhibited. Further, in the heat-and-pressure fixing method of using a heat roller, etc., the toner has excellent offset resistance, and it is fixable at a low temperature. Thus, clear images free from background contamination can be stably formed for a large amount of copying in a heat-and-pressure fixing method using a heat roller.

BRIEF DESCRIPTION OF THE DRAWING

The present invention will become more fully understood from the detailed description given hereinbelow and the accompanying drawing which is given by way of illustration only, and thus, is not limitative of the present invention, and wherein.

DETAILED DESCRIPTION OF THE INVENTION

Figure 1:
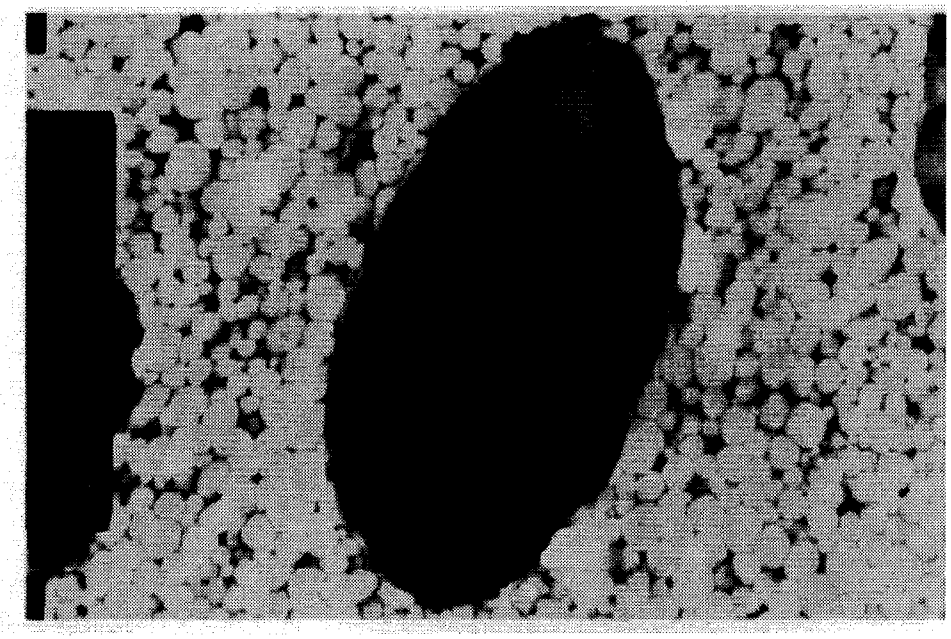
FIG. 1 is a microphotograph showing a grain structure of a toner by observing a cross section of the encapsulated toner for heat-and-pressure fixing obtained in Example 1 of the present invention using a transmission electron microscope.

In the encapsulated toner for heat-and-pressure fixing comprising a heat-fusible core material containing at least a thermoplastic resin and a shell formed thereon so as to cover the surface of the core material, the encapsulated toner of the present invention is characterized in that various additives are dispersed in the shell-forming resin.

Here, examples of various additives include conductive materials, charge control agents, wax components, color pigments, and particulate magnetic materials. These additives may be used singly or in a combination of two or more kinds.

In the present invention, since the additives normally contained in the core materials of the encapsulated toner are dispersed in the shell-forming resin, the function of the additives can be well exhibited as described in detail below. Specifically, in the present invention, at least one additive suitably chosen may be added and dispersed in the shell-forming resin in an amount so as not to lose the mechanical function of a shell, and other additives which are not dispersed in the shell-forming resin may be dispersed in the core material. Thus, there are various embodiments for the combinations of the additives as exemplified below, without intending to restrict the scope of the present invention thereto. Also, the same additive may be used for both core and shell materials.

| | | |
|---|---|---|
| (a) | Core material: | Charge control agent, wax component, color pigment, and particulate magnetic materials. |
| | Shell material: | Conductive material. |
| (b) | Core material: | Conductive material, charge control agent, wax component, and particulate magnetic materials. |
| | Shell material: | Color pigment. |
| (c) | Core material: | Conductive material, charge control agent, wax component, and color pigment. |
| | Shell material: | Particulate magnetic materials. |
| (d) | Core material: | Charge control agent, wax component, and color pigment. |
| | Shell material: | Conductive material. |
| (e) | Core material: | Conductive material, charge control agent, and wax component. |
| | Shell material: | Color pigment. |
| (f) | Core material: | Conductive material, charge control agent, color pigment, and particulate magnetic materials. |
| | Shell material: | Wax component. |
| (g) | Core material: | Charge control agent, wax component, and particulate magnetic materials. |
| | Shell material: | Conductive material and color pigment. |
| (h) | Core material: | Conductive material, color pigment, and particulate magnetic materials. |
| | Shell material: | Charge control agent and wax component. |
| (i) | Core material: | Charge control agent, color pigment, and particulate magnetic materials. |
| | Shell material: | Conductive material and wax component. |

First, the additives mentioned above will be explained in detail below.

The conductive materials (low-resistivity materials) which can be used in the present invention are not particularly limited, as long as the resistivity of the materials is in the range of from $10^{-3}$ Ωcm to $10^{3}$ Ωcm, and examples thereof include carbon black, iron (III) oxide, iron (IV) oxide, tin oxide, and titanium oxide. Among them, carbon black can be suitably used in the present invention, because it has a small particle diameter. As for carbon blacks, they are not particularly limited as long as they are produced by conventional production methods, such as a channelling method and a furnace method.

The above carbon blacks have pH values of normally from 3.0 to 10.0, preferably 5.0 to 9.0, and the weight loss of the carbon black due to volatilization is normally not more than 5% by weight, preferably not more than 3% by weight.

In general, since a resin inherently has good electric insulation, it normally has a high resistivity in the range of from $10^{12}$ Ωcm to $10^{17}$ Ωcm. However, by dispersing conductive materials in the resin as in the present invention, the resistivity of the resin can be lowered to $10^{6}$ Ωcm to $10^{11}$ Ωcm.

Conventionally, the toners which can be produced by suspension polymerization have substantially spherical shapes. Therefore, when the copying speeds or the printing speeds are fast, even if the untransferred toners remaining on the photoconductor are cleaned using a blade, the untransferred toners cannot be completely removed therefrom because the toners are strongly adhered on the photoconductor. As a result, problems such as black lines in the obtained images are incurred.

One of the causes for increasing the adhesive strength as mentioned above is presumed to be increase in the electrostatic adhesive strength due to a high electric resistivity of the toner. Specifically, the encapsulated toner produced by the polymerization method mentioned above tends to have a high electric resistivity because the toner surface is covered with the shell material resin.

As a method of lowering the electric resistivity of the toner, a method of mechanically adhering conductive materials such as carbon blacks on the toner surface as mentioned above is known. However, in this method, the conductive materials adhered to the toner surface are likely to be undesirably detached from the toner surface upon stirring in the developer device, and as a result, toner dust in machine takes place. Also, the resistivity control is difficult, and when the resistivity of the toner becomes not more than $10^{5}$ Ωcm, it would be difficult to electrostatically transfer the toner to a recording medium such as paper sheets after development by such means as corona transfer and bias transfer.

Therefore, as in the present invention, by using, as a shell material, a resin in which conductive materials are dispersed in advance, the electric resistivity of the surface of the encapsulated toner produced by the polymerization method can be controlled to reduce the adhesive strength of the untransferred toner. Even in cases where copying speeds or printing speeds are fast, the untransferred toner can be completely removed by blade cleaning, and thereby the generation of black lines can be prevented.

In the encapsulated toner for heat-and-pressure fixing according to the present invention, the conductive materials mentioned above are dispersed in the shell resin. Specifically, the conductive materials are dispersed entirely or partially in the shell resin from the vicinity of the surface of the shell to the vicinity of the interface between the shell and the core material without normally being exposed to the surface of the shell. The obtained toner in the present invention can be clearly distinguished from conventional conductive toners wherein conductive materials are coated on the toner surface or conductive materials are contained only in the core material of the encapsulated toner, because in the toner of the present invention, the conductive materials are not normally exposed to the surface of the shell and are incorporated in the shell resin.

As for the dispersion concentration in the shell resin of the conductive materials, the amount of the conductive materials is normally 5 to 50 parts by weight, preferably 10 to 40 parts by weight, based on 100 parts by weight of the shell resin from the viewpoints of the cleanability and the triboelectric chargeability of the obtained toner.

The charge control agents which can be used in the present invention include both negative charge control agents and positive charge control agents mentioned below.

The negative charge control agents are not particularly limited, and examples thereof include azo dyes containing metals such as "VARIFAST BLACK 3804" (manufactured by Orient Chemical Co., Ltd.), "BONTRON S-31" (manufactured by Orient Chemical Co., Ltd.), "BONTRON S-32" (manufactured by Orient Chemical Co., Ltd.), "BONTRON S-34" (manufactured by Orient Chemical Co., Ltd.), "AIZEN SPILON BLACK TRH" (manufactured by Hodogaya Chemical Co., Ltd.), and "T-77" (manufactured by Hodogaya Chemical Co., Ltd.); copper phthalocyanine dye; metal complexes of alkyl derivatives of salicylic acid such as "BONTRON E-81" (manufactured by Orient Chemical Co., Ltd.), "BONTRON E-82" (manufactured by Orient Chemical Co., Ltd.), and "BONTRON E-85" (manufactured by Orient Chemical Co., Ltd.); quaternary ammonium salts such as "COPY CHARGE NX VP434" (manufactured by Hoechst); and nitroimidazole derivatives.

Among the negative charge control agents, a preference is given to T-77 and AIZEN SPILON BLACK TRH.

The positive charge control agents are not particularly limited, and examples thereof include nigrosine dyes such as "NIGROSINE BASE EX" (manufactured by Orient Chemical Co., Ltd.), "OIL BLACK BS" (manufactured by Orient Chemical Co., Ltd.), "OIL BLACK SO" (manufactured by Orient Chemical Co., Ltd.), "BONTRON N-01" (manufactured by Orient Chemical Co., Ltd.), "BONTRON N-07" (manufactured by Orient Chemical Co., Ltd.), "BONTRON N-09" (manufactured by Orient Chemical Co., Ltd.), and "BONTRON N-11" (manufactured by Orient Chemical Co., Ltd.); triphenylmethane dyes containing tertiary amines as side chains; quaternary ammonium salt compounds such as "BONTRON P-51" (manufactured by Orient Chemical Co., Ltd.), cetyltrimethylammonium bromide, and "COPY CHARGE PX VP435" (manufactured by Hoechst); polyamine resins such as "AFP-B" (manufactured by Orient Chemical Co., Ltd.); and imidazole derivatives, Among the positive charge control agents, a preference is given to BONTRON N-01, BONTRON N-07, BONTRON N-09, and AFP-B.

In the toner for heat-and-pressure fixing, even if the charge control agents are not added, sufficient stability in the triboelectric charges may be achieved. However, in certain cases, background of toner on the photoconductor particularly under high-temperature and high-humidity conditions is likely to take place.

In order to solve the above problem, a method of stabilizing triboelectric charges by adding a charge control agent to the toner is known. However, when the charge control agent added is present near the central portion of the toner, sufficient effects cannot be achieved by the addition thereof. On the contrary, when the charge control agent is present on the outermost surface of the toner, particularly in a case of a two-component developer, the charge control agent is shifted to the carrier, resulting in a drastic decrease of the level of triboelectric charges of the toner. Therefore, such problems as increase in background is likely to take place.

By adding the charge control agent using the method of the present invention, the charge control agent may be incorporated into the shell resin, so that the charge control agent is present in the vicinity of the toner surface without being exposed on the outermost surface of the toner. Therefore, stable triboelectric charges can be achieved in the resulting toner even under high-temperature and high-humidity conditions without causing the shift of the charge control agent to the carrier. Thus, all of the problems are satisfactorily eliminated by the method of the present invention.

As for the dispersion concentration in the shell resin of the charge control agent, the amount of the charge control agent is normally 0.05 to 20 parts by weight, preferably 0.1 to 10 parts by weight, based on 100 parts by weight of the shell resin from the viewpoints of the image quality free from background and the image density of the obtained toner.

As for the wax components which can be used in the present invention, one or more offset inhibitors including polyolefins, metal salts of fatty acids, fatty acid esters, partially saponified fatty acid esters, higher fatty acids, higher alcohols, paraffin waxes, amide waxes, polyhydric alcohol esters, silicone varnishes, aliphatic fluorocarbons, silicone oils, microcrystalline waxes, and sasol waxes may be suitably contained.

Among the wax components, a preference is given to polyolefins, silicone oils, microcrystalline waxes, and sasol waxes.

In the toner for heat-and-pressure fixing, even if the wax components are not added, sufficient offset resistance in the resulting toner may be achieved. However, particularly in cases where the copying speeds or the printing speeds are fast and a fixing roller diameter is large, the toner is not easily detached from the fixing roller, so that separating claw traces generate in a solid image portion.

In order to solve the above problem, a method of improving releasing properties by adding a wax component to the toner is known. However, when the wax component added is present near the central portion of the toner, sufficient effects cannot be achieved by the addition thereof. On the contrary, when the wax component is present on the outermost surface of the toner, the wax component is shifted to the photoconductor, thereby making it likely to stain printed images.

By adding the wax component using the method of the present invention, the wax component may be incorporated into the shell resin, so that the wax component is present in the vicinity of the toner surface without being exposed on the outermost surface of the toner. Therefore, advantageous effects in releasing properties can be achieved in the resulting toner without shifting the wax component to the photoconductor. Thus, all of the problems are satisfactorily eliminated by the method of the present invention.

As for the dispersion concentration in the shell resin of the wax component, the amount of the wax component is normally 5 to 100 parts by weight, preferably 10 to 70 parts by weight, based on 100 parts by weight of the shell resin from the viewpoints of the releasing properties of the resulting toner and staining on the photoconductor.

As for the color pigments which can be used in the present invention, various kinds and colors of organic or inorganic pigments or dyes can be used as exemplified below.

Specifically, examples of black pigments include carbon black, copper oxide, manganese dioxide, aniline black, and active carbon.

Examples of yellow pigments include chrome yellow, zinc yellow, cadmium yellow, yellow iron oxide, mineral fast yellow, nickelotitanate yellow, naples yellow, Naphthol Yellow S, Hansa Yellow G, Hansa Yellow 10G, Benzidine Yellow G, Benzidine Yellow GR, Quinoline Yellow Lake, Permanent Yellow NCG, and Tartrazine Yellow Lake.

Examples of orange pigments include red chrome yellow, molybdenum orange, Permanent Orange GTR, Pyrazolone Orange, Vulcan Orange, Indanthrene Brilliant Orange RK, Benzidine Orange G, and Indanthrene Brilliant Orange GK.

Examples of red pigments include red iron oxide, cadmium red, red lead, silver sulfide, quinacridone, cadmium, Permanent Red 4R, Lithol Red, Pyrazolone Red, Watchung Red, calcium salts, Lake Red D, Brilliant Carmine 6B, eosine lake, Rhodamine B Lake, alizarin lake, and Brilliant Carmine 3B.

Examples of violet pigments include manganese violet, Fast Violet B, and methyl violet lake.

Examples of blue pigments include Prussian blue, cobalt blue, Alkali Blue Lake, Victoria Blue Lake, phthalocyanine blue, nonmetallic phthalocyanine blue, partially chlorinated phthalocyanine blue, Fast Sky Blue, and Indanthrene Blue BC.

Examples of green pigments include chrome green, chromium oxide, Pigment Green B, mica light green lake, and Final Yellow Green G.

Examples of white pigments include zinc flower, titanium oxide, antimony white, and zinc sulfide.

Examples of extender pigments include barite powders, barium carbonate, clay, silica, white carbon, talc, and alumina white.

Among the color pigments mentioned above, a preference is given to Benzidine Yellow G, Benzidine Yellow GR, Brilliant Carmine 6B, quinacridone, Rhodamine B Lake, phthalocyanine blue, nonmetallic phthalocyanine blue, and partially chlorinated phthalocyanine blue. These color pigments may be used singly or in a combination of two or more.

By adding the color pigment using the method of the present invention, the color pigment is localized in the shell material of the surface layer of the toner, so that good transparency of the fixed toner, namely high transmittance particularly in the case where the toner is developed and fixed on the OHP film, can be achieved, and that the color reproducibility when colors are multiply layered in a full-colored fixed image can be remarkably improved. Also, in this method, since the color pigments are not mechanically adhered on the surface of the toner, a developer free from generating toner dust in machine can be prepared.

As for the dispersion concentration in the shell resin of the color pigment, the amount of the color pigment is normally 3 to 50 parts by weight, preferably 5 to 40 parts by weight, based on 100 parts by weight of the shell resin from the viewpoints of hue and chroma.

Examples of the particulate magnetic materials which can be used in the present invention include ferrite, magnetite, ferromagnetic metals such as iron, cobalt, and nickel, or alloys thereof, and compounds containing these elements; alloys not containing any ferromagnetic element which become ferromagnetic by suitable thermal treatment, for example, so-called "Heusler alloys" containing manganese and copper such as a manganese-copper-aluminum alloy, and a manganese-copper-tin alloy; and chromium dioxide. A preference is given to ferrite and magnetite. Such a magnetic material may be uniformly dispersed in the shell material in the form of a fine powder having an average particle diameter of 0.1 to 1 μm.

When particulate magnetic materials are incorporated into the shell material in order to make it a magnetic toner, the material may be dispersed in a similar manner to that of the color pigment. However, since such particulate magnetic materials are poor in its affinity for organic substances, such as a shell resin, the material is used together with a known coupling agent such as a titanium coupling agent, a silane coupling agent or a lecithin coupling agent, with a preference given to the titanium coupling agent, or is treated with such a coupling agent prior to its use, thereby making it possible to uniformly disperse the particulate magnetic materials.

By adding the particulate magnetic materials using the method of the present invention, the particulate magnetic materials are localized in the shell material of the surface layer of the toner. Therefore, the magnetic force can be increased with a small amount of the particulate magnetic materials, so that a toner scattering is effectively prevented.

As for the dispersion concentration in the shell resin of the particulate magnetic materials, the amount of the particulate magnetic materials is normally 5 to 100 parts by weight, preferably 10 to 70 parts by weight, based on 100 parts by weight of the shell resin from the viewpoints of the magnetic force of the toner and the fixing ability.

The shell-forming resins contained in the encapsulated toner of the present invention are not particularly limited, as long as they have higher hydrophilicity than the thermoplastic resin used in the core material in the case of producing the toner by in situ method. Examples thereof include polyesters; polyesteramides; polyamides; polyureas; polymers of nitrogen-containing monomers such as dimethylaminoethyl methacrylate and diethylaminoethyl methacrylate; copolymers of the above monomers and styrene or unsaturated carboxylic acid esters; polymers of unsaturated carboxylic acids such as methacrylic acid and acrylic acid, unsaturated dibasic acids, or unsaturated dibasic acid anhydrides; and copolymers of the above monomers and styrene-type monomers. Among the shell-forming resins, an amorphous polyester is suitably used as a main component thereof in the present invention, because the resulting toner has excellent low-temperature fixing ability, etc.

The amorphous polyester in the present invention can be usually obtained by a condensation polymerization between at least one alcohol monomer selected from the group consisting of dihydric alcohol monomers and trihydric or higher polyhydric alcohol monomers and at least one carboxylic acid monomer selected from the group consisting of dicarboxylic acid monomers and tricarboxylic or higher polycarboxylic acid monomers. Among them, the amorphous polyesters obtained by the condensation polymerization of monomers essentially containing at least a trihydric or higher polyhydric alcohol monomer and/or a tricarboxylic or higher polycarboxylic acid monomer are suitably used.

The amorphous polyester described above can be contained in an amount of normally 50 to 100% by weight, based on the total weight of the shell, and the other components which may be contained in the shell include polyamides, polyester-amides, and polyurea resins in an amount of 0 to 50% by weight.

Examples of the dihydric alcohol monomers include bisphenol A alkylene oxide adducts such as polyoxypropylene(2.2)-2,2-bis(4-hydroxyphenyl)propane, polyoxypropylene(3.3)-2,2-bis(4-hydroxyphenyl)propane, polyoxypropylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, propylene adducts of bisphenol A, ethylene adducts of bisphenol A, hydrogenated bisphenol A, and other dihydric alcohol monomers.

Examples of the trihydric or higher polyhydric alcohol monomers include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and other trihydric or higher polyhydric alcohol monomers. Among the alcohol monomers, the trihydric alcohol monomers are preferably used.

In the present invention, these dihydric alcohol monomers and trihydric or higher polyhydric alcohol monomers may be used singly or in combination.

As for the acid components, examples of the dicarboxylic acid monomers include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, n-dodecylsuccinic acid, n-octylsuccinic acid, isooctenylsuccinic acid, isooctylsuccinic acid, acid anhydrides thereof, lower alkyl esters thereof, and other dicarboxylic acid components.

Examples of the tricarboxylic or higher polycarboxylic acid monomers include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Empol trimer acid, acid anhydrides thereof, lower alkyl esters thereof, and other tricarboxylic or higher polycarboxylic acid components. In the present invention, among these carboxylic acid components, a preference is given to the tricarboxylic acids or derivatives thereof.

In the present invention, these dicarboxylic acid monomers and tricarboxylic or higher polycarboxylic acid monomers may be used singly or in combination.

The method for producing an amorphous polyester in the present invention is not particularly limited, and the amorphous polyester can be produced by esterification or transesterification of the above monomers.

Here, "amorphous" refers to those which do not have a definite melting point. When a crystalline polyester is used in the present invention, the amount of energy required for fusion is large, and thereby the fixing ability of the toner becomes undesirably poor.

The glass transition temperature of the amorphous polyester thus obtained is preferably 50° to 80° C., more preferably 55° to 75° C. from the viewpoints of the storage stability and the fixing ability of the resulting toner. In the present invention, the "glass transition temperature" used herein refers to the temperature of an intersection of the extension of the baseline of not more than the glass transition temperature and the tangential line showing the maximum inclination between the kickoff of the peak and the top thereof as determined using a differential scanning calorimeter ("DSC MODEL 210," manufactured by Seiko Instruments, Inc.), at a temperature rise rate of 10° C./min.

The acid value of the above amorphous polyester is preferably 3 to 50 KOH mg/g, more preferably 10 to 30 KOH mg/g from the viewpoints of the storage stability of the resulting toner and the production stability. Here, the acid value is measured by the method according to JIS K0070.

The resins used as the main components of the heat-fusible core material in the encapsulated toner of the present invention include thermoplastic resins such as polyester resins, polyester-polyamide resins, polyamide resins, and vinyl resins, with a preference given to the vinyl resins. The glass transition temperatures ascribed to the thermoplastic resin used as the main component of the heat-fusible core material mentioned above are preferably 10° C. to 50° C., more preferably 20° C. to 45° C. from the viewpoints of the storage stability and the fixing strength of the encapsulated toner.

Among the above-mentioned thermoplastic resins, examples of the monomers of the vinyl resins include styrene and styrene derivatives such as styrene, o-methylstyrene, m-methylstyrene, p-methylstyrene, α-methylstyrene, p-ethylstyrene, 2,4-dimethylstyrene, p-chlorostyrene, and vinylnaphthalene; ethylenic unsaturated monoolefins such as ethylene, propylene, butylene, and isobutylene; vinyl esters such as vinyl chloride, vinyl bromide, vinyl fluoride, vinyl acetate, vinyl propionate, vinyl formate, and vinyl caproate; ethylenic monocarboxylic acids and esters thereof such as acrylic acid, methyl acrylate, ethyl acrylate, n-propyl acrylate, isopropyl acrylate, n-butyl acrylate, isobutyl acrylate, t-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl α-chloroacrylate, methacrylic acid, methyl methacrylate, ethyl methacrylate, n-propyl methacrylate, isopropyl methacrylate, n-butyl methacrylate, isobutyl methacrylate, t-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate, and diethylaminoethyl methacrylate; substituted monomers of ethylenic monocarboxylic acids such as acrylonitrile, methacrylonitrile, and acrylamide; ethylenic dicarboxylic acids and substituted monomers thereof such as dimethyl maleate; vinyl ketones such as vinyl methyl ketone; vinyl ethers such as vinyl methyl ether; vinylidene halides such as vinylidene chloride; and N-vinyl compounds such as N-vinylpyrrole and N-vinylpyrrolidone.

Among the above core material resin components in the present invention, it is preferred that styrene or styrene derivatives is used in an amount of 50 to 90% by weight to form the main structure of the resins, and that the ethylenic monocarboxylic acid or esters thereof is used in an amount of 10 to 50% by weight in order to adjust the thermal properties such as the softening point of the resins, because the glass transition temperature of the core material resin can be easily controlled.

A crosslinking agent may be added, if necessary, to the monomer composition. In such a case, any known crosslinking agents may be suitably used. Examples of crosslinking agents added to monomer compositions constituting the core material resins include any of the generally known crosslinking agents such as divinylbenzene, divinylnaphthalene, polyethylene glycol dimethacrylate, diethylene glycol diacrylate, triethylene glycol diacrylate, 1,3-butylene glycol dimethacrylate, 1,6-hexylene glycol dimethacrylate, neopentyl glycol dimethacrylate, dipropylene glycol dimethacrylate, polypropylene glycol dimethacrylate, 2,2'-bis(4-methacryloxydiethoxyphenyl)propane, 2,2'-bis(4-acryloxydiethoxyphenyl)propane, trimethylolpropane trimethacrylate, trimethylolpropane triacrylate, tetramethylolmethane tetraacrylate, dibromoneopentyl glycol dimethacrylate, and diallyl phthalate. Among them, a preference is given to divinylbenzene and polyethylene glycol dimethacrylate. These crosslinking agents may be used alone or, if necessary, in a combination of two or more.

The amount of these crosslinking agents used is preferably 0.001 to 15% by weight, more preferably 0.1 to 10% by weight, based on the vinyl polymerizable monomers from the viewpoints of the heat fixing ability and the heat-and-pressure fixing ability of the resulting toner free from "offset phenomenon" wherein a part of the toner cannot be completely fixed on a paper but rather adheres to the surface of a heat roller, which in turn is transferred to a subsequent paper.

A graft or crosslinked polymer prepared by polymerizing the above monomers in the presence of an unsaturated polyester may be also used as the resin for the core material.

Examples of the polymerization initiators to be used in the production of the thermoplastic resin for the core material include azo and diazo polymerization initiators such as 2,2'-azobis(2,4-dimethylvaleronitrile), 2,2'-azobisisobutyronitrile, 1,1'-azobis(cyclohexane-1-carbonitrile), and 2,2'-azobis-4-methoxy-2,4-dimethylvaleronitrile; and peroxide polymerization initiators such as benzoyl peroxide, methyl ethyl ketone peroxide, isopropyl peroxycarbonate, cumene hydroperoxide, 2,4-dichlorobenzoyl peroxide, lauroyl peroxide, and dicumyl peroxide.

For the purposes of controlling the molecular weight or molecular weight distribution of the polymer or controlling the reaction time, two or more polymerization initiators may be used in combination. The amount of the polymerization initiator used is 0.1 to 20 parts by weight, preferably 1 to 10 parts by weight, based on 100 parts by weight of the monomers to be polymerized.

Next, the method for production of the encapsulated toner of the present invention will be explained in detail below. The encapsulated toners of the present invention are suitably produced by in situ polymerization method from the viewpoint of simplicity in the production facilities and the production steps.

In the method for producing an encapsulated toner for heat-and-pressure fixing of the present invention comprising a heat-fusible core material containing at least a thermoplastic resin and a shell formed thereon so as to cover the surface of the core material, the method comprises the steps of:

(a) dispersing in a shell-forming resin an additive selected from the group consisting of conductive materials, charge control agents, wax components, color pigments, particulate magnetic materials, and mixtures thereof to give a shell-forming resin containing the additive;

(b) dissolving the shell-forming resin containing the additive in a mixture comprising a core material-constituting monomer;

(c) dispersing the mixture obtained in step (b) in an aqueous dispersant, and localizing the shell-forming resin containing the additive on the surface of droplets of the core-constituting material to give a polymerizable composition; and (d) polymerizing the polymerizable composition obtained in step (c) by in situ polymerization to form the core material, the shell in which the additive is dispersed covering the surface of the core material.

In the method for production of the encapsulated toner of the present invention, the shell can be formed by utilizing the property that when a mixed solution comprising the core-constituting materials and the shell-forming material is dispersed in an aqueous dispersant, the shell-forming material localizes onto the surface of the oil droplets. Specifically, the separation of the core-constituting materials and the shell-forming material in the oil droplets of the mixed solution takes place due to the difference in the hydrophilic property, and the polymerization proceeds in this state to form core material resin and at the same time to form a shell with resins containing the additive, and thereby an encapsulated structure is formed. By this method, a shell is formed as a layer of shell-forming materials with a substantially uniform thickness, so that the triboelectric chargeability of the toner becomes uniform.

Incidentally, a general method of encapsulation by in situ polymerization is carried out by supplying monomers for shell-forming resins, polymerization initiators, etc. from either one of the inner phase or outer phase of the dispersed phase and forming a shell resin by polymerization to give an encapsulated structure (see *Microcapsule*, T. Kondo and N. Koishi, 1987, published by Sankyo Shuppan Kabushiki Kaisha). On the other hand, in in situ polymerization in the present invention, since the core material resin is formed in the inner portion of the shell resin by polymerizing monomers for the core material resins, the encapsulation mechanism in the present invention is somewhat different from that of the general encapsulation in in situ polymerization method. However, since in the method of the present invention, the monomers are supplied only from the inner phase of the dispersed phase, the present method may be a sort of in situ polymerization in a broader sense.

As explained above, in situ polymerization used in the present invention is characterized in that only the core material resin is polymerized and a shell-forming resin is prepared in advance. In the present invention, by using the shell-forming resin prepared in advance, a shell having a suitable, uniform thickness can be obtained, so that the triboelectric chargeability of the toner becomes uniform and the storage stability becomes excellent. Also, the present invention is characterized in that a resin in which the additives are dispersed therein is used as a shell-forming resin, so that the additives are incorporated in the shell resin of the obtained toner.

On the other hand, a process for the continuous preparation of an encapsulated toner, comprising continuously separately feeding an oil phase containing core monomers, oil soluble shell monomers and pigment and an aqueous phase containing surfactant into a continuous flowthrough mixing tank; homogenizing the aforementioned two phases to enable small oil droplets; overflowing the resulting droplets to at least one continuously stirred tank reactor while simultaneously feeding water soluble shell monomer to the stirred reactor to effect interfacial polymerization thereby causing shell formation; and thereafter allowing the encapsulated droplets to flow into a reactor or reactors and heating the reactor or reactors to effect free radical polymerization of the core monomers, is known (see U.S. Pat. Nos. 5,035,970, 5,153,093 and 5,264,315). However, in the above methods, since the shell-forming resin is formed by interfacial polymerization, the shell thickness is not easily controlled and becomes thin. In these cases, when high-strength resins having high-melting points of not less than 300° C., such as polyureas and polyurethanes, are used as the shell-forming resin, the fixing ability of the toner becomes poor, even though the storage stability is good. On the other hand, when low-strength resins, such as polyesters having low-melting points, are used as the shell-forming resin, the storage stability of the toner becomes undesirably poor. By contrast, in the present invention, the shell material thickness can be easily controlled, so that both the fixing ability and the storage ability of the toner can be satisfied. Moreover, since in the above known methods, a shell is formed by reacting the oil soluble shell monomers and the water soluble shell monomers at the interface of oil droplets and water phase, it would be in principle impossible to incorporate the additives in the shell.

Thus, the encapsulation method in the present invention is clearly distinguishable from the method of encapsulation wherein the interfacial polymerization is carried out to form the shell-forming resin upon encapsulation.

In in situ polymerization method explained above in the present invention, by dispersing various additives in a shell-forming resin in advance, a shell in which various additives are dispersed can be formed. By this method, since various additives are dispersed in the shell-forming resin without being present on the surface of the toner, conventional problems in which various additives are detached from the toner upon stirring in the developer device and thereby generating toner dust in machine are not incurred. Also, as explained above, the function of each of various additives can be well exhibited.

As for methods for dispersing additives in the shell-forming resin, any of the conventionally known methods may be employed. For instance, the additives and the shell-forming resin may be melt-kneaded to disperse using a twin-screw kneader, a banbury mixer, or a kneader, or the additives may be melt-blended at the time of production of the shell-forming resin.

In the present invention, when the mixed solution comprising the core-constituting materials and the shell-forming materials is dispersed in an aqueous dispersant, a dispersion stabilizer is added into the dispersion medium in order to prevent aggregation and incorporation of the dispersed substances.

Examples of the dispersion media include water, methanol, ethanol, propanol, butanol, ethylene glycol, glycerol, acetonitrile, acetone, isopropyl ether, tetrahydrofuran, and dioxane, among which water is preferably used as an essential component. These dispersion media can be used singly or in combination.

Examples of the dispersion stabilizers include gelatin, gelatin derivatives, polyvinyl alcohol, polystyrenesulfonic acid, hydroxymethylcellulose, hydroxyethylcellulose, hydroxypropylcellulose, sodium carboxymethylcellulose, sodium polyacrylate, sodium dodecylbenzenesulfonate, sodium tetradecyl sulfate, sodium pentadecyl sulfate, sodium octyl sulfate, sodium allyl alkyl polyethersulfonate, sodium oleate, sodium laurate, sodium caprate, sodium caprylate, sodium caproate, potassium stearate, calcium oleate, sodium 3,3-disulfonediphenylurea-4,4-diazobisamino-β-naphthol-6sulfonate, o-carboxybenzeneazodimethylaniline, sodium 2,2,5,5-tetramethyltriphenylmethane-4,4-diazobis-βnaphtholdisulfonate, colloidal silica, alumina, tricalcium phosphate, ferrous hydroxide, titanium hydroxide, and aluminum hydroxide, with a preference given to tricalcium phosphate. These dispersion stabilizers may be used alone or in combination of two or more.

In the method for the production of the present invention, the amount of the above shell-forming resin as the main component is normally 3 to 50 parts by weight, preferably 5 to 40 parts by weight, more preferably 8 to 30 parts by weight, based on 100 parts by weight of the core material from the viewpoints of the storage stability of the obtained toner and the production stability.

In present invention, the encapsulated toner produced by the method explained above may be used as precursor particles, and seed polymerization may be further conducted to give an encapsulated toner for heat-and-pressure fixing. Therefore, in the present invention, there are two embodiments for the encapsulated toners of the present invention: One wherein the encapsulated toner is produced by in situ polymerization alone, and another wherein the encapsulated toner is produced by a combination of in situ polymerization and seed polymerization.

The seed polymerization in the present invention comprises the steps of adding at least a vinyl polymerizable monomer and an initiator for vinyl polymerization to an aqueous suspension of the encapsulated toner produced by the method explained above (hereinafter which may be simply referred to as "precursor particles") to absorb them into the precursor particles; and polymerizing the monomer components in the above precursor particles.

For instance, when the precursor particles are produced by in situ polymerization method described above, at least a vinyl polymerizable monomer and an initiator for vinyl polymerization are immediately added to the precursor particles in a suspending state, and the monomer and the initiator are absorbed into the precursor particles, so that seed polymerization takes place with the monomer components absorbed in the precursor particles. By this method, the production steps can be simplified. The vinyl polymerizable monomers, etc. which are added to be absorbed into the precursor particles may be used in a state of an aqueous emulsion.

The aqueous emulsion to be added can be obtained by emulsifying and dispersing the vinyl polymerizable monomer and the initiator for vinyl polymerization in water together with a dispersion stabilizer, which may further contain other additives such as a crosslinking agent, an offset inhibitor and a charge control agent.

The vinyl polymerizable monomers used in the seed polymerization may be the same ones as those used for the production of the precursor particles. Also, the initiators for vinyl polymerization, the crosslinking agents and the dispersion stabilizers may also be the same ones as those used for the production of the precursor particles. The amount of the crosslinking agent used in the seed polymerizaztion is preferably 0.001 to 15% by weight, more preferably 0.1 to 10% by weight, based on the vinyl polymerizable monomers for similar reasons for the crosslinking agents used in the production of the precursor particles.

In order to further improve the storage stability of the toner, hydrophilic shell-forming materials such as the amorphous polyester described above may be added to the aqueous emulsion. In this case, the amount of the shell-forming material added is normally 1 to 20 parts by weight, preferably 3 to 15 parts by weight, based on 100 parts by weight of the core material. Also, in the present invention, the various additives mentioned above may be dispersed in the shell-forming resins in advance, and in this case, the additives may be similarly selected from the conductive materials, charge control agents, wax components, color pigments, particulate magnetic materials, and mixtures thereof.

Further, other examples of the hydrophilic shell materials than the amorphous polyesters including vinyl resins having hydrophilic functional groups, such as carboxyl group, acid anhydride group, hydroxyl group, amino group, and ammonium ion, amorphous polyesteramide resins, amorphous polyamide resins, and epoxy resins may be also used.

The aqueous emulsion described above can be prepared by uniformly dispersing the mixture using such devices as an ultrasonic vibrator.

The acid value of the amorphous polyester used in the seed polymerization, as in the case of that used in in situ polymerization reaction, is preferably 3 to 50 KOH mg/g, more preferably 10 to 30 KOH mg/g for similar reasons for the acid value of the amorphous polyester used in the production of the precursor particles.

The amount of the aqueous emulsion added is adjusted so that the amount of the vinyl polymerizable monomer used is 10 to 200 parts by weight, based on 100 parts by weight of the precursor particles from the viewpoints of the fixing ability of the resulting toner and uniform absorption of the monomer components in the precursor particles.

By adding the aqueous emulsion thereto, the vinyl polymerizable monomer is absorbed into the precursor particles so that the swelling of the precursor particles takes place. In the seed polymerization reaction, the monomer components in the precursor particles are polymerized in the above state. This polymerization may be referred to as "seed polymerization," wherein the precursor particles are used as seed particles.

As explained above, the following features are improved when compared with the case where the encapsulated toner is produced solely by in situ polymerization method.

Specifically, the encapsulated toner produced by in situ polymerization method has more excellent low-temperature fixing ability and storage stability than conventional toners, and by further carrying out the seed polymerization method, a shell is formed more uniformly by the principle of surface science, thereby achieving a further excellent storage stability. Also, since the polymerizable monomer in the core material can be polymerized in two steps, namely, in situ polymerization reaction and the seed polymerization reaction, the molecular weight of the thermoplastic resin in the core material can be easily controlled by using a suitable amount of the crosslinking agent, thereby making the low-temperature fixing ability and the offset resistance more excellent. In particular, a toner suitable not only for a high-speed fixing but also for a low-speed fixing can be produced.

Although the particle diameter of the encapsulated toner produced by the method described above is not particularly limitative, the average particle diameter is usually 3 to 30 μm. The thickness of the shell of the encapsulated toner is preferably 0.01 to 1 μm from the viewpoints of the blocking resistance and the heat fusibility of the resulting toner.

In the encapsulated toner of the present invention, a fluidity improver, or a cleanability improver may be used, if necessary. Examples of the fluidity improvers include silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide and silicon nitride, with a preference given to finely powdered silica.

The finely powdered silica is a fine powder having Si—O—Si linkages, which may be prepared by either the dry process or the wet process. The finely powdered silica may be not only anhydrous silicon dioxide but also any one of aluminum silicate, sodium silicate, potassium silicate, magnesium silicate and zinc silicate, with a preference given to those containing not less than 85% by weight of $SiO_2$. Further, finely powdered silica surface-treated with a silane coupling agent, a titanium coupling agent, silicone oil, and silicone oil having amine in the side chain thereof can be used.

The cleanability improvers include fine powders of metal salts of higher fatty acids typically exemplified by zinc stearate or fluorocarbon polymers.

Further, for the purpose of controlling the developability of the encapsulated toner, finely powdered polymers of methyl methacrylate or butyl methacrylate may be added.

Furthermore, for the purpose of reducing electric resistance on the surface of the toner, a small amount of carbon black may be used. The carbon blacks may be those of conventionally known, including various kinds such as furnace black, channel black, and acetylene black.

When the encapsulated toner of the present invention contains particulate magnetic materials, it can be used alone as a developer, while when the encapsulated toner does not contain any particulate magnetic material, a non-magnetic one-component developer or a two-component developer can be prepared by mixing the toner with a carrier. Although the carrier is not particularly limitative, examples thereof include iron powder, ferrite, glass beads, those of above with resin coatings, and resin carriers in which magnetite fine powders or ferrite fine powders are blended into the resins. The mixing ratio of the toner to the carrier is 0.5 to 20% by weight. The particle diameter of the carrier is 15 to 500 μm.

When the encapsulated toner of the present invention is fixed on a recording medium such as paper by heat and pressure, an excellent fixing strength is attained. As for the heat-and-pressure fixing process to be suitably used in the fixing of the toner of the present invention, any one may be used as long as both heat and pressure are utilized. Examples of the fixing processes which can be suitably used in the present invention include a known heat roller fixing process; a fixing process as disclosed in Japanese Patent Laid Open No. 2-190870 in which visible images formed on a recording medium in an unfixed state are fixed by heating and fusing the visible images through the heat-resistant sheet with a heating means, comprising a heating portion and a heat-resistant sheet, thereby fixing the visible images onto the recording medium; and a heat-and-pressure process as disclosed in Japanese Patent Laid-Open No. 2-162356 in which the formed visible images are fixed on a recording medium through a film by using a heating element fixed to a support and a pressing member arranged opposite to the heating element in contact therewith under pressure.

EXAMPLES

The present invention is hereinafter described in more detail by means of the following working examples, comparative examples and test examples, but the present invention is not limited by these examples.

Resin Production Example 1

367.5 g of a propylene oxide adduct of bisphenol A, 146.4 g of an ethylene oxide adduct of bisphenol A, 126.0 g of terephthalic acid, 40.2 g of dodecenyl succinic anhydride, and 77.7 g of trimellitic anhydride are placed in a two-liter four-necked glass flask equipped with a thermometer, a stainless steel stirring rod, a reflux condenser and a nitrogen inlet tube, and allowed to react with one another at 220° C. in a mantle heater under a nitrogen gas stream while stirring.

The degree of polymerization is monitored by a softening point measured according to ASTM E 28-67, and the reaction is terminated when the softening point reaches 110° C. This resin is referred to as "Resin A."

The glass transition temperature of Resin A measured by a differential scanning calorimeter ("DSC Model 220," manufactured by Seiko Instruments, Inc.) is 65° C., and its acid value measured by the method according to JIS K0070 is 18 KOH mg/g.

Resin Production Example 2

514.5 g of a propylene oxide adduct of bisphenol A, 204.8 g of an ethylene oxide adduct of bisphenol A, 226.6 g of terephthalic acid, and 48.0 g of trimellitic anhydride are placed in a two-liter four-necked glass flask equipped with a thermometer, a stainless steel stirring rod, a reflux condenser and a nitrogen inlet tube, and allowed to react with one another at 220° C. in a mantle heater under a nitrogen gas stream while stirring.

The degree of polymerization is monitored by a softening point measured according to ASTM E 28-67, and the reaction is terminated when the softening point reaches 105° C. This resin is referred to as "Resin B."

The glass transition temperature of Resin B measured by a differential scanning calorimeter ("DSC Model 220," manufactured by Seiko Instruments, Inc.) is 63° C., and its acid value measured by the method according to JIS K0070 is 12 KOH mg/g.

Resin Production Example 3

525 g of a propylene oxide adduct of bisphenol A, 136.5 g of terephthalic acid, and 160.8 g of dodecenyl succinic anhydride are placed in a two-liter four-necked glass flask equipped with a thermometer, a stainless steel stirring rod, a reflux condenser and a nitrogen inlet tube, and allowed to react with one another at 220° C. in a mantle heater under a nitrogen gas stream while stirring.

The degree of polymerization is monitored by a softening point measured according to ASTM E 28-67, and the reaction is terminated when the softening point reaches 110° C. This resin is referred to as "Resin C."

The glass transition temperature of Resin C measured by a differential scanning calorimeter ("DSC Model 220," manufactured by Seiko Instruments, Inc.) is 63° C., and its acid value measured by the method according to JIS K0070 is 10 KOH mg/g.

Example 1

100 parts by weight of Resin A and 25 parts by weight of carbon black "MONARCH 880" (manufactured by Cabot Corporation) are blended well using a Henshel mixer, and the mixture is kneaded and cooled using a twin-screw extruder equipped with a Barrel cooling system. The obtained mixture is pulverized to give Kneaded Mixture A.

Here, the resistivity of Resin A and Kneaded Mixture A are $5\times10^{13}$ Ωcm and $2.2\times10^{7}$ Ωcm, respectively.

The resistivity is measured by the following procedures.

First, in order to prepare a sample, the roughly pulverized product is filled into a tablet molding machine, and a load of 10 tons is applied to the product to give pellets having a thickness of about 2 mm and a diameter of 60 mm. A value of resistive component R is measured by an alternating current bridge method using an impedance analyzer "HP4284A," (manufactured by Yokogawa-Hewlett-Packard, Ltd.) is used as a resistivity of the resin sample.

20 parts by weight of Kneaded Mixture A and 4.5 parts by weight of 2,2'-azobisisobutyronitrile are added to a mixture comprising 69.0 parts by weight of styrene, 31.0 parts by weight of 2-ethylhexyl acrylate, and 1.1 parts by weight of divinylbenzene. The mixture is dispersed using a magnetic stirrer for 1 hour, to give a polymerizable composition.

Next, 120 g of the above polymerizable composition is added to 280 g of a 4% by weight aqueous colloidal solution of tricalcium phosphate which is previously prepared in a one-liter separable glass flask. The obtained mixture is dispersed with a "T. K. HOMO MIXER, Model M" (manufactured by Tokushu Kika Kogyo) at 15° C. and a rotational speed of 10000 rpm for 3 minutes.

Next, a four-necked glass cap is set on the flask, and a reflux condenser, a thermometer, a nitrogen inlet tube and a stainless steel stirring rod are attached thereto. The flask is placed in an electric mantle heater. Thereafter, the contents are heated to 80° C. and allowed to react with at 80° C. for 8 hours in a nitrogen atmosphere while stirring.

After the reaction product is cooled, 220 ml of 1N hydrochloric acid is added to the dispersing agent. The resulting product is filtered, and the obtained solid is washed with water, dried under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" (manufactured by Nippon Aerozil Ltd.) is added and mixed to obtain the encapsulated toner according to the present invention. This toner is referred to as "Toner 1."

The glass transition temperature ascribed to the resin contained in the core material is 34.5° C., and the softening point of Toner 1 is 128.3° C.

The resulting toner is uniformly dispersed in a vinyl acetate resin (woodworking bond, manufactured by Konishi, Ltd.), and the obtained mixture is kept standing at room temperature for 1 week. The toner-containing resin is stained with an osmium aqueous solution. Thereafter, the dyed resin is sliced into thin pieces of about several hundred nanometers using an ultramicrotome ("ULTROTOME NOVA," manufactured by LKB). FIG. 1 is its microphotograph (magnification: 5,000) obtained by a scanning electron microscope ("JEM-2000FX," manufactured by JEOL, Ltd. (Nippon Denshi Kabushiki Kaisha)).

As for the encapsulated toner obtained in the present invention, it is confirmed that the conductive material is dispersed in the shell resin.

Example 2

100 parts by weight of Resin B and 25 parts by weight of carbon black "REGAL 99R" (manufactured by Cabot Corporation) are blended well using a Henshel mixer, and the mixture is kneaded and cooled using a twin-screw extruder equipped with a Barrel cooling system. The obtained mixture is pulverized to give Kneaded Mixture B.

Here, the resistivity of Resin B and Kneaded Mixture B are $5\times10^{13}$ Ωcm and $6.5\times10^{8}$ Ωcm, respectively.

10 parts by weight of carbon black "GPT-505P" (manufactured by Ryoyu Kogyo) used as a coloring agent, 15 parts by weight of Kneaded Mixture B, and 4.5 parts by weight of 2,2'-azobisisobutyronitrile are added to a mixture comprising 69.0 parts by weight of styrene, 31.0 parts by weight of 2-ethylhexyl acrylate, and 1.1 parts by weight of divinylbenzene, and the obtained mixture is dispersed for 1 hour using a magnetic stirrer to give a polymerizable composition.

Next, 120 g of the above polymerizable composition is added to 280 g of a 4% by weight aqueous colloidal solution of tricalcium phosphate which is previously prepared in a one-liter separable glass flask. The obtained mixture is dispersed with a "T. K. HOMO MIXER, Model M" (manufactured by Tokushu Kika Kogyo) at a rotational speed of 10000 rpm for 3 minutes.

Next, a four-necked glass cap is set on the flask, and a reflux condenser, a thermometer, a nitrogen inlet tube and a stainless steel stirring rod are attached thereto. The flask is placed in an electric mantle heater. Thereafter, the contents are heated to 80° C. and allowed to react with at 80° C. for 8 hours in a nitrogen atmosphere while stirring.

After the reaction product is cooled, 220 ml of 1N hydrochloric acid is added to the dispersing agent. The resulting product is filtered, and the obtained solid is washed with water, dried under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" (manufactured by Nippon Aerozil Ltd.) is added and mixed to obtain the encapsulated toner according to the present invention. This toner is referred to as "Toner 2."

The glass transition temperature ascribed to the resin contained in the core material is 34.1° C., and the softening point of Toner 2 is 125.5° C.

Example 3

100 parts by weight of Resin A and 20 parts by weight of conductive tin oxide "T-1" (manufactured by Mitsuibishi Metal Corporation) are blended well using a Henshel mixer, and the mixture is kneaded and cooled using a twin-screw extruder equipped with a Barrel cooling system. The obtained mixture is pulverized to give Kneaded Mixture C.

Here, the resistivity of Kneaded Mixture C are $5.2\times10^9$ Ωcm.

The similar procedures to those of Example 2 are carried out up to the surface treatment step except that Kneaded Mixture B is replaced with Kneaded Mixture C to give an encapsulated toner. This toner is referred to as "Toner 3."

The glass transition temperature ascribed to the resin contained in the core material is 35.1° C., and the softening point of Toner 3 is 127.5° C.

Comparative Example 1

The similar procedures to those of Example 1 are carried out up to the surface treatment step except that Kneaded Mixture A is replaced with Resin A to give a comparative encapsulated toner. This toner is referred to as "Comparative Toner 1."

The glass transition temperature ascribed to the resin contained in the core material is 34.5° C., and the softening point of Comparative Toner 1 is 130.1° C.

Comparative Example 2

100 parts by weight of the encapsulated toner produced by similar procedures to those of Example 1 except that Kneaded Mixture A is replaced with Resin A and 6 parts by weight of carbon black "MONARCH 880" (manufactured by Cabot Corporation) are well blended with a Henshel mixer. Next, the carbon black is fixed on the surface of the toner particles by a hybridization treatment.

To 100 parts by weight of this encapsulated toner, 0.4 parts by weight of hydrophobic silica fine powder "Aerozil R-972" (manufactured by Nippon Aerozil Ltd.) is added and mixed to obtain a comparative toner. This toner is referred to as "Comparative Toner 2."

Example 4

100 parts by weight of Resin A and 10 parts by weight of negative charge control agent "T-77" (manufactured by Hodogaya Chemical Co., Ltd.) are blended well using a Henshel mixer, and the mixture is kneaded and cooled using a twin-screw extruder equipped with a Barrel cooling system. The obtained mixture is pulverized to give Kneaded Mixture D.

20 parts by weight of styrene-grafted carbon black "GPE-3" (manufactured by Ryoyu Kogyo) used as a coloring agent and 15.0 parts by weight of Kneaded Mixture D are added to a mixture comprising 69.0 parts by weight of styrene, 31.0 parts by weight of 2-ethylhexyl acrylate, and 6.0 parts by weight of 2,2'-azobisisobutyronitrile, and the obtained mixture is dispersed for 1 hour using a magnetic stirrer to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with a "T. K. HOMO MIXER, Model M" (manufactured by Tokushu Kika Kogyo) at 15° C. and a rotational speed of 10000 rpm for 3 minutes.

Next, a four-necked glass cap is set on the flask, and a reflux condenser, a thermometer, a nitrogen inlet tube and a stainless steel stirring rod are attached thereto. The flask is placed in an electric mantle heater. Thereafter, as the first-step reaction, the contents are heated to 85° C. and subjected to a polymerization reaction for 10 hours in a nitrogen atmosphere while stirring to give seed particles. The seed particles are cooled to room temperature to give precursor particles.

Next, 42.7 parts by weight of an aqueous emulsion comprising 13.0 parts by weight of styrene, 7.0 parts by weight of 2-ethylhexyl acrylate, 0.4 parts by weight of 2,2'-azobisisobutyronitrile, 0.22 parts by weight of divinylbenzene, 2.0 parts by weight of Kneaded Mixture D, 0.1 parts by weight of sodium laurylsulfate, and 20 parts by weight of water is added dropwise to an aqueous suspension containing the above precursor particles, the emulsion being prepared by a ultrasonic vibrator ("US-150," manufactured by Nippon Seiki Co., Ltd.). Thereafter, as the second-step polymerization, the contents are heated to 85° C. and subjected to a reaction for 10 hours in a nitrogen atmosphere while stirring. After the reaction product is cooled, 440 ml of 1N hydrochloric acid is added to the dispersing agent. The resulting product is filtered, and the obtained solid is washed with water, and air-dried, followed by drying under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" (manufactured by Nippon Aerozil Ltd.) is added and mixed to obtain the encapsulated toner according to the present invention. This toner is referred to as "Toner 4."

The glass transition temperature ascribed to the resin contained in the core material is 27.5° C., and the softening point of Toner 4 is 108.0° C.

Example 5

100 parts by weight of Resin B and 10 parts by weight of positive charge control agent "BONTRON N-01" (manufactured by Orient Chemical Co., Ltd.) are blended well using a Henshel mixer, and the mixture is kneaded and cooled using a twin-screw extruder equipped with a Barrel cooling system. The obtained mixture is pulverized to give Kneaded Mixture E.

The similar procedures to those of Example 4 are carried out up to the surface treatment step except that Kneaded Mixture D is replaced with Kneaded Mixture E to give an encapsulated toner according to the present invention. This toner is referred to as "Toner 5."

The glass transition temperature ascribed to the resin contained in the core material is 27.0° C., and the softening point of Toner 5 is 107.0° C.

Example 6

100 parts by weight of Resin C and 10 parts by weight of negative charge control agent "AIZEN SPILON BLACK TRH" (manufactured by Hodogaya Chemical Co., Ltd.) are blended well using a Henshel mixer, and the mixture is kneaded and cooled using a twin-screw extruder equipped with a Barrel cooling system. The obtained mixture is pulverized to give Kneaded Mixture F.

The similar procedures to those of Example 4 are carried out up to the surface treatment step except that Kneaded Mixture D is replaced with Kneaded Mixture F to give an encapsulated toner according to the present invention. This toner is referred to as "Toner 6."

The glass transition temperature ascribed to the resin contained in the core material is 28.0° C., and the softening point of Toner 6 is 108.5° C.

Comparative Example 3

The similar procedures to those of Comparative Example 2 are carried out up to the surface treatment step except that the carbon black "MONARCH 880" is replaced with 5 parts by weight of negative charge control agent "T-77" (manufactured by Hodogaya Chemical Co., Ltd.) to give a comparative encapsulated toner. This toner is referred to as "Comparative Toner 3."

Example 7

100 parts by weight of Resin A and 20 parts by weight of polyethylene wax "HIWAX 200P" (manufactured by Mitsui Petrochemical Industries, Ltd.) are blended well using a Henshel mixer, and the mixture is kneaded and cooled using a twin-screw extruder equipped with a Barrel cooling system. The obtained mixture is pulverized to give Kneaded Mixture G.

The similar procedures to those of Example 2 are carried out up to the surface treatment step except that Kneaded Mixture B is replaced with Kneaded Mixture G to give an encapsulated toner according to the present invention. This toner is referred to as "Toner 7."

The glass transition temperature ascribed to the resin contained in the core material is 36.0° C., and the softening point of Toner 7 is 126.0° C.

Example 8

100 parts by weight of Resin A and 20 parts by weight of polypropylene wax "NP-055" (manufactured by Mitsui Petrochemical Industries, Ltd.) are blended well using a Henshel mixer, and the mixture is kneaded and cooled using a twin-screw extruder equipped with a Barrel cooling system. The obtained mixture is pulverized to give Kneaded Mixture H.

The similar procedures to those of Example 2 are carried out up to the surface treatment step except that Kneaded Mixture B is replaced with Kneaded Mixture H to give an encapsulated toner according to the present invention. This toner is referred to as "Toner 8."

The glass transition temperature ascribed to the resin contained in the core material is 36.5° C., and the softening point of Toner 8 is 128.0° C.

Comparative Example 4

The similar procedures to those of Comparative Example 2 are carried out up to the surface treatment step except that the carbon black "MONARCH 880" is replaced with 10 parts by weight of polypropylene wax "NP-055" (manufactured by Mitsui Petrochemical Industries, Ltd.) to give a comparative encapsulated toner. This toner is referred to as "Comparative Toner 4."

Example 9

100 parts by weight of Resin B and 25 parts by weight of magnetite "EPT-1001" (manufactured by Toda Kogyo Corporation) are blended well using a Henshel mixer, and the mixture is kneaded and cooled using a twin-screw extruder equipped with a Barrel cooling system. The obtained mixture is pulverized to give Kneaded Mixture I.

The similar procedures to those of Example 2 are carried out up to the surface treatment step except that Kneaded Mixture B is replaced with Kneaded Mixture I to give an encapsulated toner according to the present invention. This toner is referred to as "Toner 9."

The glass transition temperature ascribed to the resin contained in the core material is 35.8° C., and the softening point of Toner 9 is 127.0° C.

Comparative Example 5

The similar procedures to those of Comparative Example 2 are carried out up to the surface treatment step except that the carbon black "MONARCH 880" is replaced with 10 parts by weight of magnetite "EPT-1001" (manufactured by Toda Kogyo Corporation) to give a comparative encapsulated toner. This toner is referred to as "Comparative Toner 5."

Example 10

100 parts by weight of Resin B and 25 parts by weight of yellow pigment "SEIKAFAST YELLOW 2400" (manufactured by Dainichiseika Color & Chemicals Manufacturing Co., Ltd.) are blended well using a Henshel mixer, and the mixture is kneaded and cooled using a twin-screw extruder equipped with a Barrel cooling system. The obtained mixture is pulverized to give Kneaded Mixture J.

15 parts by weight of Kneaded Mixture J and 4.5 parts by weight of 2,2'-azobisisobutyronitrile are added to a mixture comprising 69.0 parts by weight of styrene, 31.0 parts by weight of 2-ethylhexyl acrylate, and 1.1 parts by weight of divinylbenzene, and the obtained mixture is dispersed for 1 hour using a magnetic stirrer to give a polymerizable composition.

Next, 120 g of the above polymerizable composition is added to 280 g of a 4% by weight aqueous colloidal solution of tricalcium phosphate which is previously prepared in a one-liter separable glass flask. The obtained mixture is dispersed with a "T. K. HOMO MIXER, Model M" (manufactured by Tokushu Kika Kogyo) at a rotational speed of 10000 rpm for 3 minutes.

Next, a four-necked glass cap is set on the flask, and a reflux condenser, a thermometer, a nitrogen inlet tube and a stainless steel stirring rod are attached thereto. The flask is placed in an electric mantle heater. Thereafter, the contents are heated to 80° C. and subjected to a reaction for 8 hours in a nitrogen atmosphere while stirring.

After the reaction product is cooled, 220 ml of 1N hydrochloric acid is added to the dispersing agent. The resulting product is filtered, and the obtained solid is washed with water, dried under a reduced pressure of 20 mmHg at 45° C. for 12 hours and classified with an air classifier to give an encapsulated toner with an average particle size of 8 pm whose shell comprises an amorphous polyester.

To 100 parts by weight of this encapsulated toner, 0.4 parts by weight of hydrophobic silica fine powder "Aerozil R-972" (manufactured by Nippon Aerozil Ltd.) is added and mixed to obtain the encapsulated toner according to the present invention. This toner is referred to as "Toner 10."

The glass transition temperature ascribed to the resin contained in the core material is 34.5° C., and the softening-point of Toner 10 is 126.0° C.

Example 11

100 parts by weight of Resin B and 25 parts by weight of magenta pigment "HOSTAPERM PINK EB" (manufactured by Hoechst) are blended well using a Henshel mixer, and the mixture is kneaded and cooled using a twin-screw extruder equipped with a Barrel cooling system. The obtained mixture is pulverized to give Kneaded Mixture K.

The similar procedures to those of Example 10 are carried out up to the surface treatment step except that Kneaded Mixture J is replaced with Kneaded Mixture K to give an encapsulated toner according to the present invention. This toner is referred to as "Toner 11."

The glass transition temperature ascribed to the resin contained in the core material is 35.0° C., and the softening point of Toner 11 is 126.5° C.

Example 12

100 parts by weight of Resin C and 25 parts by weight of magenta pigment "HOSTAPERM PINK EB" (manufactured by Hoechst) are blended well using a Henshel mixer, and the mixture is kneaded and cooled using a twin-screw extruder equipped with a Barrel cooling system. The obtained mixture is pulverized to give Kneaded Mixture L.

The similar procedures to those of Example 10 are carried out up to the surface treatment step except that Kneaded Mixture J is replaced with Kneaded Mixture L to give an encapsulated toner according to the present invention. This toner is referred to as "Toner 12."

The glass transition temperature ascribed to the resin contained in the core material is 34.3° C., and the softening point of Toner 12 is 125.8° C.

Example 13

100 parts by weight of Resin B and 25 parts by weight of cyan pigment "KET BLUE 104" (manufactured by Dainippon Ink and Chemicals, Inc.) are blended well using a Henshel mixer, and the mixture is kneaded and cooled using a twin-screw extruder equipped with a Barrel cooling system. The obtained mixture is pulverized to give Kneaded Mixture M.

The similar procedures to those of Example 10 are carried out up to the surface treatment step except that Kneaded Mixture J is replaced with Kneaded Mixture M to give an encapsulated toner according to the present invention. This toner is referred to as "Toner 13."

The glass transition temperature ascribed to the resin contained in the core material is 34.0° C., and the softening point of Toner 13 is 125.5° C.

Example 14

100 parts by weight of Resin C and 25 parts by weight of cyan pigment "KET BLUE 104" (manufactured by Dainippon Ink and Chemicals, Inc.) are blended well using a Henshel mixer, and the mixture is kneaded and cooled using a twin-screw extruder equipped with a Barrel cooling system. The obtained mixture is pulverized to give Kneaded Mixture N.

The similar procedures to those of Example 10 are carried out up to the surface treatment step except that Kneaded Mixture J is replaced with Kneaded Mixture N to give an encapsulated toner according to the present invention. This toner is referred to as "Toner 14."

The glass transition temperature ascribed to the resin contained in the core material is 33.5° C., and the softening point of Toner 14 is 125.0° C.

Comparative Example 6

The similar procedures to those of Comparative Example 2 are carried out up to the surface treatment step except that the carbon black "MONARCH 880" is replaced with 10 parts by weight of yellow pigment "SEIKAFAST YELLOW 2400" (manufactured by Dainichiseika Color & Chemicals Manufacturing Co., Ltd.) to give a comparative encapsulated toner. This toner is referred to as "Comparative Toner 6."

Example 15

100 parts by weight of Resin A, 10 parts by weight of negative charge control agent "T-77" (manufactured by Hodogaya Chemical Co., Ltd.), and 20 parts by weight of polypropylene wax "NP-055" (manufactured by Mitsui Petrochemical Industries, Ltd.) are blended well using a Henshel mixer, and the mixture is kneaded and cooled using a twin-screw extruder equipped with a Barrel cooling system. The obtained mixture is pulverized to give Kneaded Mixture O.

The similar procedures to those of Example 4 are carried out up to the surface treatment step except that Kneaded Mixture D is replaced with Kneaded Mixture O to give an encapsulated toner according to the present invention. This toner is referred to as "Toner 15."

The glass transition temperature ascribed to the resin contained in the core material is 28.0° C., and the softening point of Toner 15 is 109.0° C.

Example 16

100 parts by weight of Resin A, 10 parts by weight of positive charge control agent "BONTRON N-01" (manufactured by Orient Chemical Co., Ltd.), and 25 parts by weight of carbon black "MONARCH 880" (manufactured by Cabot Corporation) are blended well using a Henshel mixer, and the mixture is kneaded and cooled using a twin-screw extruder equipped with a Barrel cooling system. The obtained mixture is pulverized to give Kneaded Mixture P.

The similar procedures to those of Example 4 are carried out up to the surface treatment step except that Kneaded Mixture D is replaced with Kneaded Mixture P to give an encapsulated toner according to the present invention. This toner is referred to as "Toner 16."

The glass transition temperature ascribed to the resin contained in the core material is 27.7° C., and the softening point of Toner 16 is 108.8° C.

Test Example

Each of the toners obtained in Examples 1 to 16 and Comparative Examples 1 to 6 is evaluated with respect to the triboelectric charge, the fixing ability, the blocking resistance, the cleanability, and the toner dust in machine, using a developer, which is prepared by placing 6 parts by weight of each of the toners and 94 parts by weight of spherical ferrite powder coated with styrene-methyl methacrylate copolymer resin having a particle size of 250 mesh-pass and 400 mesh-on into a polyethylene container, and mixing the above components by rotation of the container on the roller at a rotational speed of 150 rpm for 20 minutes. The triboelectric charge, the fixing ability, the blocking resistance, the cleanability, and the toner dust in machine are evaluated by the following methods.

(1) Triboelectric charge

The triboelectric charge is measured by a blow-off type electric charge measuring device as described below. Specifically, a specific charge measuring device equipped with a Faraday cage, a capacitor and an electrometer is used. First, W (g) (about 0.15 to 0.20 g) of the developer prepared above is placed into a brass measurement cell equipped with a stainless screen of 500 mesh, which is adjustable to any mesh size to block the passing of the carrier particles. Next, after aspirating from a suction opening for 5 seconds, blowing is carried out for 5 seconds under a pressure indicated by a barometric regulator of 0.6 kgf/cm$^2$, thereby selectively removing only the toner from the cell.

In this case, the voltage of the electrometer after 2 seconds from the start of blowing is defined as V (volt). Here, when the electric capacitance of the capacitor is defined as C (μF), the specific triboelectric charge Q/m of this toner can be calculated by the following equation:

$$Q/m\ (\mu C/g)=C\times V/m$$

Here, m is the weight of the toner contained in W (g) of the developer. When the weight of the toner in the developer is defined as T (g) and the weight of the developer as D (g), the toner concentration in a given sample can be expressed as T/D×100(%), and m can be calculated as shown in the following equation:

$$m\ (g)=W\times(T/D).$$

The measurement results of the triboelectric charge of the developer prepared under normal conditions are shown in Tables 1 to 6.

TABLE 1

| No. | Kneaded Resin | Photo-conductor | Peripheral Speed (mm/s) | Tribo-electric Charge (μC/g) | Lowest Fixing Temp. (°C.) | Low-Temp. Offset Temp. (°C.) | High-Temp. Offset Temp. (°C.) | Blocking Resistance | Effects |
|---|---|---|---|---|---|---|---|---|---|
| Examples | | | | | | | | | |
| 1 | Kneaded Mixture A = Resin A + MONARCH 880 | Selene-Arsenic | 450 | −16.3 | 160 | 130 | 220 | Good | Good Cleanability after 10,000 Sheets |
| 2 | Kneaded Mixture B = Resin B + REGAL 99R | Selene-Arsenic | 450 | −15.7 | 150 | 125 | 220 | Good | Good Cleanability after 10,000 Sheets |
| 3 | Kneaded Mixture C = Resin A + T-1 | Selene-Arsenic | 450 | −18.0 | 155 | 130 | 220 | Good | Good Cleanability after 10,000 Sheets |
| Comparative Examples | | | | | | | | | |
| 1 | Resin A | Selene-Arsenic | 450 | −21.5 | 160 | 128 | 220 | Good | Poor Cleanability after 500 Sheets |
| 2 | Hybridization Treatment Using MONARCH 880 | Selene-Arsenic | 450 | −9.0 | 160 | 130 | 220 | Good | Toner Dust in Machine after 1,000 Sheets |

TABLE 2

| No. | Kneaded Resin | Photo-conductor | Peripheral Speed (mm/s) | Tribo-electric Charge (μC/g) | Lowest Fixing Temp. (°C.) | Low-Temp. Offset Temp. (°C.) | High-Temp. Offset Temp. (°C.) | Blocking Resistance | Effects |
|---|---|---|---|---|---|---|---|---|---|
| Examples | | | | | | | | | |
| 4 | Kneaded Mixture D = Resin A + Charge Control Agent T-77 | Selene-Arsenic | 255 | −28.0 | 105 | 100 | 220 | Good | Low Background on Photo-conductor at High-Temp., High-Humidity |
| 5 | Kneaded Mixture E = Resin B + Charge Control Agent N-01 | Organic Photocon-ductor | 255 | +15.0 | 103 | 100 | 220 | Good | Low Background on Photo-conductor at High-Temp., High-Humidity |
| 6 | Kneaded Mixture F = Resin C + Charge Control Agent TRH | Selene-Arsenic | 255 | −27.5 | 104 | 100 | 220 | Good | Low Background on Photo-conductor at High-Temp., High-Humidity |
| Comparative Example 3 | Hybridization Treatment Using T-77 | Selene-Arsenic | 255 | −10.0 | 110 | 100 | 220 | Good | Toner Dust in Machine after 1,000 Sheets |

TABLE 3

| No. | Kneaded Resin | Photo-conductor | Peripheral Speed (mm/s) | Tribo-electric Charge (μC/g) | Lowest Fixing Temp. (°C.) | Low-Temp. Offset Temp. (°C.) | High-Temp. Offset Temp. (°C.) | Blocking Resistance | Effects |
|---|---|---|---|---|---|---|---|---|---|
| Examples | | | | | | | | | |
| 7 | Kneaded Mixture G = Resin A + Polyethylene Wax | Selene-Arsenic | 255 | −26.5 | 122 | 100 | 240 | Good | Wider High-Temp. Offset Region |
| 8 | Kneaded Mixture H = Resin A + Polypropylene Wax | Selene-Arsenic | 255 | −27.0 | 124 | 100 | 240 | Good | Wider High-Temp. Offset Region |
| Comparative Example 4 | Hybridization Treatment Using Polypropylene Wax | Selene-Arsenic | 255 | −20.5 | 125 | 100 | 240 | Good | Background on Photoconductor after 1,000 sheets |

TABLE 4

| No. | Kneaded Resin | Photo-conductor | Peripheral Speed (mm/s) | Tribo-electric Charge (μC/g) | Lowest Fixing Temp. (°C.) | Low-Temp. Offset Temp. (°C.) | High-Temp. Offset Temp. (°C.) | Blocking Resistance | Effects |
|---|---|---|---|---|---|---|---|---|---|
| Example 9 | Kneaded Mixture I = Resin B + Particulate Magnetic Material | Selene-Arsenic | 255 | −23.5 | 120 | 100 | 220 | Good | Lower Toner Dust |
| Comparative Example 5 | Hybridization Treatment Using Particulate Magnetic Material | Selene-Arsenic | 255 | −15.2 | 125 | 110 | 220 | Good | Background on Photoconductor after 1,000 sheets |

TABLE 5

| No. | Kneaded Resin | Photo-conductor | Peripheral Speed (mm/s) | Tribo-electric Charge (μC/g) | Lowest Fixing Temp. (°C.) | Low-Temp. Offset Temp. (°C.) | High-Temp. Offset Temp. (°C.) | Blocking Resistance | Effects |
|---|---|---|---|---|---|---|---|---|---|
| Examples | | | | | | | | | |
| 10 | Blended Mixture J = Resin B + Yellow Pigment | Selene-Arsenic | 255 | −26.5 | 122 | 100 | 220 | Good | Good Transparency Low-Temp. Fixing Color Toner |
| 11 | Blended Mixture K = Resin B + Magenta Pigment | Selene-Arsenic | 255 | −26.0 | 118 | 100 | 220 | Good | Good Transparency Low-Temp. Fixing Color Toner |
| 12 | Blended Mixture L = Resin C + Magenta Pigment | Selene-Arsenic | 255 | −25.0 | 115 | 100 | 220 | Good | Good Transparency Low-Temp. Fixing Color Toner |
| 13 | Blended Mixture M = Resin B + Cyan Pigment | Selene-Arsenic | 255 | −25.5 | 120 | 100 | 220 | Good | Good Transparency Low-Temp. Fixing Color Toner |
| 14 | Blended Mixture N = Resin C + Cyan Pigment | Selene-Arsenic | 255 | −25.2 | 115 | 100 | 220 | Good | Good Transparency Low-Temp. Fixing Color Toner |
| Comparative Example 6 | Hybridization Treatment Using Yellow Pigment | Selene-Arsenic | 255 | −16.5 | 125 | 110 | 220 | Good | Toner Dust in Machine after 1,000 Sheets |

TABLE 6

| No. | Kneaded Resin | Photo-conductor | Peripheral Speed (mm/s) | Tribo-electric Charge (μC/g) | Lowest Fixing Temp. (°C.) | Low-Temp. Offset Temp. (°C.) | High-Temp. Offset Temp. (°C.) | Blocking Resis-tance | Effects |
|---|---|---|---|---|---|---|---|---|---|
| Examples | | | | | | | | | |
| 15 | Kneaded Mixture O = Resin A + T-77 + Polypropylene Wax | Selene-Arsenic | 255 | −26.2 | 107 | 70 | 240 | Good | Low Background on Photoconductor and Wider High-Temp. Offset Region |
| 16 | Kneaded Mixture P = Resin A + MONARCH 880 + N-01 | Organic Photocon-ductor | 450 | +12.5 | 155 | 130 | 220 | Good | Good Cleanability after 10,000 Sheets and Background on Photoconductor |

(2) Fixing ability

The fixing ability is evaluated by the method as described below. Specifically, each of the developers prepared as described above is loaded on a commercially available electrophotographic copy machine to develop images. Each of the copy machine is equipped with a photoconductor shown in Tables 1 to 6; a fixing roller having a rotational speed shown in Tables 1 to 6; and a fixing device with variable temperature upon heat-and-pressure fixing; and an oil applying device being removed from the copy machine. By controlling the fixing temperature from 100° C. to 240° C., the fixing ability and the offset resistance of the formed images are evaluated. The results are also shown in Tables 1 to 6.

The lowest fixing temperature used herein is the temperature of the fixing roller at which the fixing ratio of the toner exceeds 70%. This fixing ratio of the toner is determined by placing a load of 500 g on a sand-containing rubber eraser (LION No. 502) having a bottom area of 15 ml×7.5 mm which contacts the fixed toner image, placing the loaded eraser on a fixed toner image obtained in the fixing device, moving the loaded eraser on the image backward and forward five times, measuring the optical reflective density of the eraser-treated image with a reflective densitometer manufactured by Macbeth Process Measurements Co., and then calculating the fixing ratio from the density values before and after the eraser treatment using the following equation.

$$\text{Fixing ratio (\%)} = \frac{\text{Image density after eraser treatment}}{\text{Image density before eraser treatment}} \times 100$$

(3) Blocking Resistance

The blocking resistance is determined by evaluating the extent of the generation of aggregation after the toner is kept standing under the conditions at a temperature of 50° C. and a relative humidity of 40% for 24 hours. The results are also shown in Tables 1 to 6.

(4) Toner Dust in Machine

The toner dust in machine is evaluated by counting the number of paper sheets having dark line due to poor cleanability on a paper used as an image-receiving sheet by carrying out continuous copy of 10,000 sheets using the above-mentioned electrophotographic copy machine (cleaning of photoconductor being conducted by blade cleaning method). Similarly, the number of paper sheets at which toner dust takes place is also noted. The results are also shown in Tables 1 to 6.

(5) Offset resistance

The offset resistance is evaluated by measuring the temperature of the low-temperature offset disappearance and the temperature of the high-temperature offset initiation. Specifically, copying tests are carried out by raising the temperature of the heat roller surface in the range from 70° C. to 240° C., and at each temperature, the adhesion of the toner onto the heat roller surface for fixing is evaluated with naked eyes.

As is clear from Tables 1 to 6, all of Toners 1 to 16 according to the present invention achieve excellent effects ascribed to the addition of the various additives mentioned in Tables 1 to 6 without causing the generation of toner dust in machine, and they have good low-temperature fixing ability and good blocking resistance.

On the other hand, in the case of Comparative Toner 1 where a conductive material is not contained, black line due to poor cleanability is generated, and thereby the formed images are deteriorated. Also, in cases of Comparative Toners 2, 3, 5, and 6 where an additive, such as a conductive material, a charge control agent, a particulate magnetic material, and a coloring pigment, is respectively fixed on the toner surface, the toner dust in machine due to scattering of the additives, such as a conductive material, takes place. Further, in the case of Comparative Toner 4 where a wax ingredient is fixed on the toner surface, staining of a photoconductor by the wax ingredient takes place.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for producing an encapsulated toner for heat-and-pressure fixing comprising a heat-fusible core material containing at least a thermoplastic resin, and a shell formed thereon so as to cover the surface of the core material, said shell having additives dispersed therein the method comprising the steps of:

(a) dispersing in a shell-forming resin an additive selected from the group consisting of conductive materials, charge control agents, wax components, color pigments, particulate magnetic materials, and mixtures thereof to give a shell-forming resin containing the additive;

(b) dissolving the shell-forming resin containing the additive in a mixture comprising a core material-constituting monomer;

(c) dispersing the mixture obtained in step (b) in an aqueous dispersant, and localizing the shell-forming resin containing the additive on the surface of droplets of the core material-constituting monomer to give a polymerizable composition; and (d) polymerizing the polymerizable composition obtained in step c) by in situ polymerization to form said encapsulated toner in which the additive is dispersed in said shell.

2. The method according to claim 1, wherein a main component of the shell-forming resin is an amorphous polyester.

3. The method according to claim 2, wherein the amorphous polyester is obtained by a condensation polymerization of monomers containing a dihydric alcohol monomer and a dicarboxylic acid monomer, and further at least a trihydric or higher polyhydric alcohol monomer and/or a tricarboxylic or higher polycarboxylic acid monomer, and wherein the amorphous polyester has a glass transition temperature of 50° to 80° C. and an acid value of 3 to 50 KOHmg/g.

4. The method according to claim 1, further comprising the steps of:

adding at least a vinyl polymerizable monomer and an initiator for vinyl polymerization to an aqueous suspension of the encapsulated toner produced in step (d) to absorb the vinyl polymerizable monomer and the initiator for vinyl polymerization into the encapsulated toner; and polymerizing the monomer components in said encapsulated toner by seed polymerization.

5. The method according to claim 1, wherein the dispersion concentration of the conductive material is 5 to 50 parts by weight, based on 100 parts by weight of the shell resin.

6. The method according to claim 1, wherein the dispersion concentration of the charge control agent is 0.05 to 20 parts by weight, based on 100 parts by weight of the shell resin.

7. The method according to claim 1, wherein the dispersion concentration of the wax component is 5 to 100 parts by weight, based on 100 parts by weight of the shell resin.

8. The method according to claim 1, wherein the dispersion concentration of the color pigment is 3 to 50 parts by weight, based on 100 parts by weight of the shell resin.

9. The method according to claim 1, wherein the dispersion concentration of the particulate magnetic materials is 5 to 100 parts by weight, based on 100 parts by weight of the shell resin.

10. An encapsulated toner for heat-and-pressure fixing comprising a heat-fusible core material containing at least a thermoplastic resin, and a shell formed thereon so as to cover the surface of the core material, wherein the shell comprises an amorphous polyester and an additive selected from the group consisting of conductive materials, charge control agents, wax components, color pigments, particulate magnetic materials, and mixtures thereof dispersed in said amorphous polyester.

11. The encapsulated toner for heat-and-pressure fixing according to claim 10, wherein said conductive material is contained in the shell in an amount of 5 to 50 parts by weight, based on 100 parts by weight of the shell resin.

12. The encapsulated toner for heat-and-pressure fixing according to claim 10, wherein said charge control agent is contained in the shell in an amount of 0.05 to 20 parts by weight, based on 100 parts by weight of the shell resin.

13. The encapsulated toner for heat-and-pressure fixing according to claim 10, wherein said wax component is contained in the shell in an amount of 5 to 100 parts by weight, based on 100 parts by weight of the shell resin.

14. The encapsulated toner for heat-and-pressure fixing according to claim 10, wherein said color pigment is contained in the shell in an amount of 3 to 50 parts by weight, based on 100 parts by weight of the shell resin.

15. The encapsulated toner for heat-and-pressure fixing according to claim 10, wherein said particulate magnetic materials are contained in the shell in an amount of 5 to 100 parts by weight, based on 100 parts by weight of the shell resin.

16. The encapsulated toner for heat-and-pressure fixing according to claim 10, wherein a main component of the shell-forming resin is an amorphous polyester.

17. The encapsulated toner for heat-and-pressure fixing according to claim 16, wherein the amorphous polyester is obtained by a condensation polymerization of monomers containing a dihydric alcohol monomer and a dicarboxylic acid monomer, and further at least a trihydric or higher polyhydric alcohol monomer and/or a tricarboxylic or higher polycarboxylic acid monomer, and wherein the amorphous polyester has a glass transition temperature of 50° to 80° C. and an acid value of 3 to 50 KOHmg/g.

18. The method according to claim 1, wherein said shell of the encapsulated toner formed contains an additive selected from the group consisting of conductive materials, charge control agents, wax components, color pigments, particulate magnetic materials, and mixtures thereof.

* * * * *